United States Patent [19]

Copping et al.

[11] 4,102,041

[45] Jul. 25, 1978

[54] METHOD OF MAKING MICROWAVE OVEN SEAL STRUCTURE

[75] Inventors: John R. Copping; Richard A. Foerstner, both of Iowa City, Iowa

[73] Assignee: Amana Refrigeration, Inc., Amana, Iowa

[21] Appl. No.: 782,113

[22] Filed: Mar. 28, 1977

[51] Int. Cl.[2] ..... H01P 11/00; H05B 9/06

[52] U.S. Cl. ..... 29/600; 29/460; 29/509; 29/527.2; 29/527.4; 219/10.55 D

[58] Field of Search ..... 29/DIG. 39, 600, 460, 29/509, 527.2, 527.4, DIG. 3, DIG. 38; 219/10.55 M, 10.55 D, 10.55 R, 10.55 E; 228/155

[56] References Cited

U.S. PATENT DOCUMENTS

| | | | |
|---|---|---|---|
| 3,182,164 | 5/1965 | Ironfield | 219/10.55 D |
| 3,584,177 | 6/1971 | Bucksbaum | 219/10.55 D |
| 3,666,904 | 5/1972 | Krajewski | 219/10.55 D |
| 3,767,884 | 10/1973 | Osepchuk et al. | 219/10.55 D |
| 3,838,495 | 10/1974 | Kuhnert | 29/527.2 X |
| 4,013,861 | 3/1977 | Westfall | 219/10.55 D |

FOREIGN PATENT DOCUMENTS

| | | | |
|---|---|---|---|
| 2,363,076 | 3/1975 | Fed. Rep. of Germany | 219/10.55 D |

*Primary Examiner*—Victor A. DiPalma

*Attorney, Agent, or Firm*—M. D. Bartlett; J. D. Pannone; J. R. Inge

[57] ABSTRACT

A microwave oven having a door formed from metal structural elements which are welded together and coated with a nonconductive coating. Solid dielectric portions of the microwave seal choke are inserted into the choke regions of the door seal, and slotted portions of one of the steel structural elements are then deformed to form the choke and to lock the solid dielectric portions in place.

10 Claims, 8 Drawing Figures

METHOD OF MAKING MICROWAVE OVEN SEAL STRUCTURE

BACKGROUND OF THE INVENTION

Microwave ovens have been constructed in which the door periphery and adjacent oven wall portions are shaped to form a microwave energy seal for preventing the emission of microwave energy from inside the oven to the regions adjacent the outside of the oven. Such seals have generally been formed with a quarter wave choke structure which resonates at the frequency of the microwave energy supplied to the interior of the oven and cooperates with other portions of the seal structure to inhibit the transmission of microwave energy from the interior of the oven through a transmission structure formed by the spaced metal conductors of the oven wall and the metal conductors of the oven door. Such spacings have generally been found desirable either separated by air or by solid dielectrics to prevent arcing between the metal of the door and the metal of the oven wall at points where microwave energy field concentrations exceed the breakdown voltage of air or cooking vapors escaping from the oven. Such doors have structural members formed of materials such as stainless steel or aluminum which have low losses at microwave frequencies, and the microwave characteristics of the choke and other portions of the seal structure do not change dimensionally with time due to corrosion or other factors.

In the case of stainless steel structures, these were constructed by welding together several substantially planar members which had been partially deformed to form the sides of a door and then welding a stainless steel sheet containing door apertures and extensions beyond the periphery of the door which could be deformed to form portions of a choke seal. Such welding to form an accurate door which would for production purposes fit into any one of a number of ovens made to production tolerances requires jigging and piece alignment which is expensive as well as requiring the use of relatively expensive stainless steel sheet material. Cast aluminum door structures require relatively expensive aluminum castings and mold structures. In addition, such cast structures cannot be readily changed during production to meet changes in tolerances encountered due to wear of jigs and fixtures or changes in material specifications.

SUMMARY OF THE INVENTION

In accordance with this invention, a microwave structure is provided in which a substantially rigid metal element has a deformable metal element attached thereto, for example, by welding. The assembly is coated with a nonconductive coating, and a nonconductive member, such as a plastic member, which is positioned between the rigid metal member and the deformable metal member is locked in place when the deformable member is deformed around the nonconductive element. The resultant structure has interior angles in the region of the junction between the two conductive members and in the region of deformation of the deformable member which are coated with the non-conductive coating and, hence, being protected from corrosion, are electrically stable.

More specifically, in accordance with this invention, a microwave oven may incorporate this microwave structure in the microwave seal between the oven and a door, with dimensional tolerances of the door provided by the rigid conductive member which may be formed by die stamping or casting. For example, while cast or sheet aluminum, stainless steel or other metals may be used, the door may be preferably formed of a first member of cold rolled carbon steel whose peripheral area is bent to form a substantially rigid metal element forming portions of the conductive walls of the microwave seal structure, and a second deformable member of sheet carbon steel spot welded to the first member, with overlapping portions being partially deformed into a second wall of the choke. The welded steel members are then coated with a protective coating of nonconductive material, such as plastic or paint, which prevents deterioration of the welded structures and, hence, maintains the electrical characteristics of the finished choke structure constant.

Further in accordance with this invention, there is provided a method of assembly of the door in which, following coating of the steel structures which have been welded together, solid dielectric elements are inserted into the choke structure, and the overhanging portions of the second metal member are further deformed to accurate dimensions to enclose the solid dielectric member in microwave choke regions of the door seal.

In accordance with this invention, there is further disclosed that the choke structure with radially extending slots for inhibiting peripheral propagation of microwave energy around the door along the seal is enhanced by the use of conductive choke wall members having a greater microwave loss than stainless steel and, more specifically, cold rolled carbon steel.

This invention further provides that the rigid and deformable conductive members of the door are each formed, together with their peripheral regions, of one piece by stamping from sheet carbon steel.

This invention further discloses that the increased microwave loss of the carbon steel conductive walls may be further augmented by the use of a plastic loaded with carbon at the outer edge of the seal to absorb energy passing from the interior of the oven through the microwave seal between the oven door and the oven wall.

BRIEF DESCRIPTION OF THE DRAWINGS

Other and further objects and advantages of the invention will be apparent as the description thereof progresses, reference being had to the accompanying drawings wherein.

DESCRIPTION OF THE PREFERRED EMBODIMENT

Figure 1:
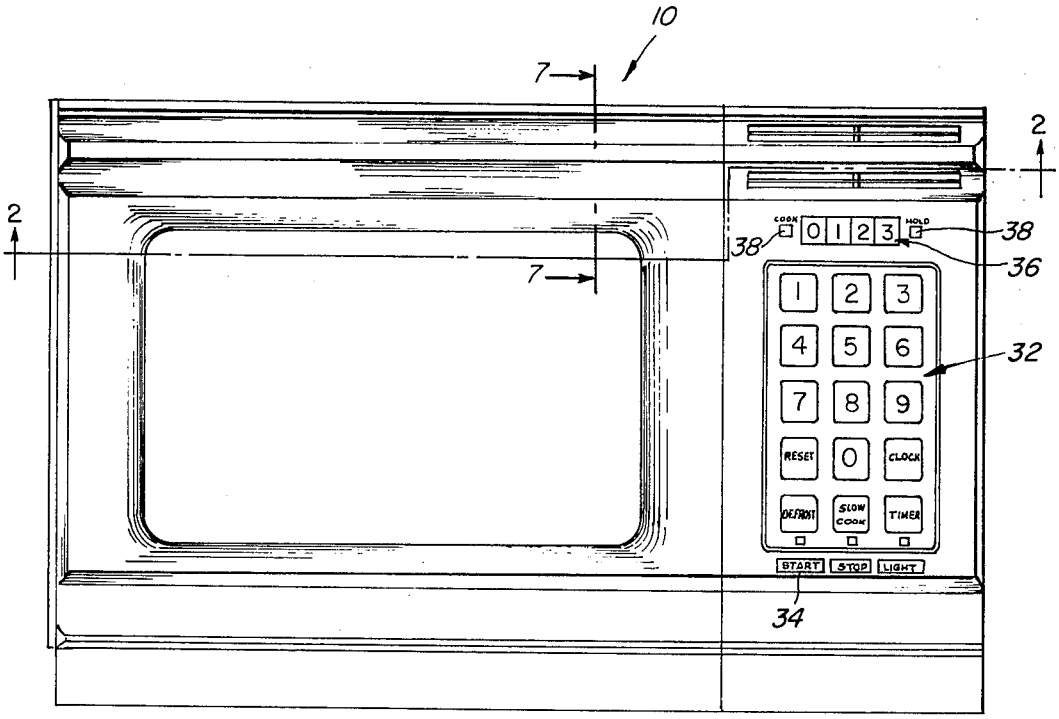
FIG. 1 illustrates a front elevational view of a microwave oven embodying the invention.
Figure 2:
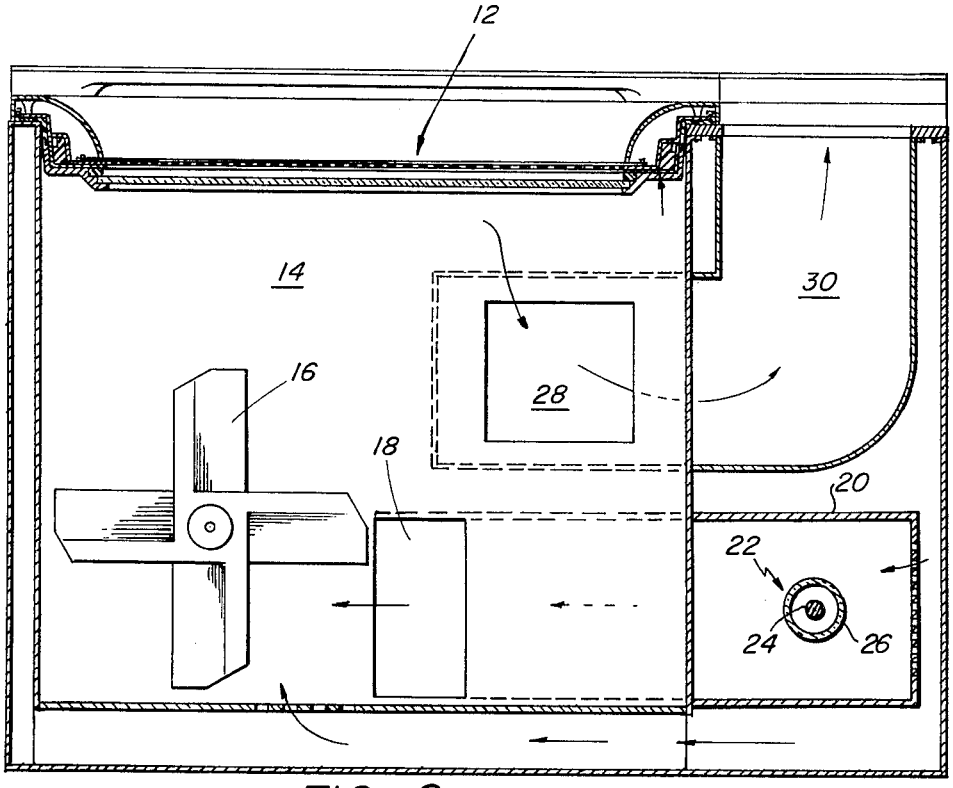
FIG. 2 illustrates a sectional view of the oven shown in FIG. 1 taken along line 2—2 of FIG. 1.

Referring now to FIGS. 1 and 2, there is shown a microwave oven 10 having a door 12 closing an access aperture in a cavity 14. Cavity 14 contains a mode stirrer 16 for uniformly distributing microwave energy supplied to cavity 14 through a coupling aperture 18 extending through the top wall of cavity 14 and the bottom wall of a waveguide structure 20 which is fed by a magnetron 22 having an output radiator 24 covered by an output ceramic seal 26 and extending into waveguide 20.

Air is directed into an end of the waveguide 20 past magnetron seal 26 and through aperture 18 into the cavity 14. The air flows out through an outlet aperture 28 and a duct 30 to the outside of the oven front. Such air is moved by means of a blower (not shown) which may, for example, also cool the magnetron anode.

As illustrated herein, operation of the oven is controlled by digitally programming a cooking sequence front touch panel 32 and then depressing start button 34 to start the cooking cycle. Various functions such as time may also be displayed in a display section 36 or by means of individual lights 38. The particular details of the oven, microwave feed structure, digital control and air circulation system are disclosed by way of example only, and any desired microwave energy feed structure, control system and air circulation system can be used.

Referring now to FIGS. 3 through 8, the door 12 is formed by die forming a first planar member 42 from sheet steel to create a portion extending around the periphery of the door 12, having an aperture 44 therein. Member 44 has an annular portion 46 extending at right angles to the plane of aperture 44 from planar member 42 which forms a portion of a microwave seal choke structure for the microwave seal of the door. A portion 48 of the first member attached to portion 46 is bent parallel to the plane of aperture 44, forming an end wall of the choke structure. A portion 50 of the first member is connected to portion 48 by a short portion 51 to form a wall portion of an output of the seal.

Figure 3:
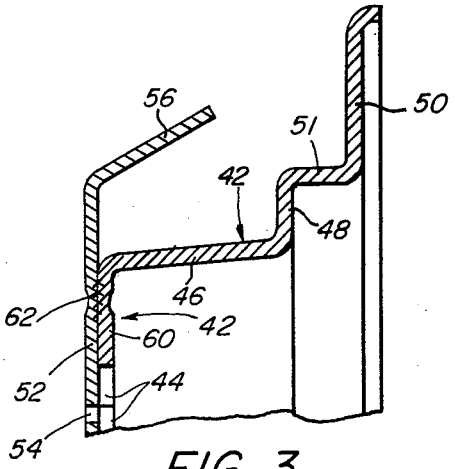
FIGS. 3 through 6 illustrate constructional steps for forming the door structure.

As shown in FIG. 3, a second member of flat sheet steel is die stamped to form a planar portion 52 containing apertures 54 which align with the aperture 44. Peripheral edge portions 56 of member 52 are first formed at an angle of, for example, 45° and overhang the portion 46 of the first member. Portions 56 are separated by slots 58 as shown, for example, more clearly in FIG. 8. The planar portion 52 of the second member is welded to peripheral planar portion 60 of the first member, for example, by spot welding at 62.

Figure 4:
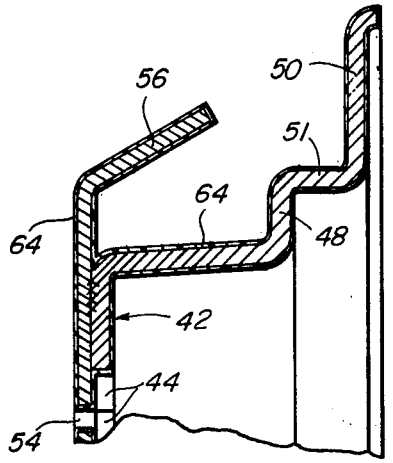

As shown in FIG. 4, the welded structure is coated with a dielectric coating 64 which covers both members and extends through the apertures 54 and around the periphery of the aperture 44 so that no portions of the steel are exposed. While the coating may be of any desired protective material, in accordance with this invention it is preferably formed of two layers. A first layer may be, for example, epoxy which may be applied in accordance with well-known practice by mixing two constituents of epoxy paint and spraying it on the elements prior to completion of the hardening reaction, or the epoxy may be applied by a bath containing epoxy material and the application of an electric field. A second coating, which adheres well to the epoxy coating, is preferably high dielectric strength material such as an acrylic which is sprayed on and reduces any deterioration of the epoxy or the metal covered thereby in the event of corona discharge from microwave energy fields in the oven seal structure or in other portions of the oven door.

Figure 5:
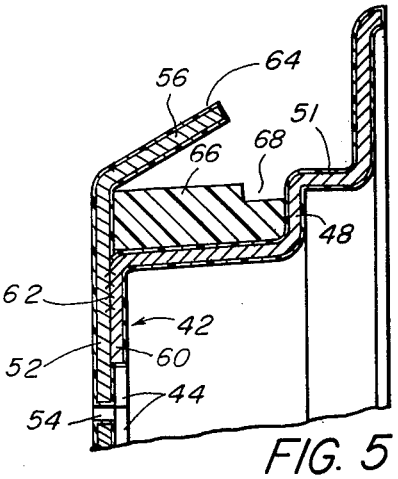

As shown in FIG. 5, blocks of dielectric 66 are then inserted in the choke region of the door, such blocks being, for example, straight members extending along the edges of the door and meeting at the corners. The dielectric blocks in accordance with well-known practice have a dielectric constant substantially greater than unity, for example, between five and 20, thereby reducing the required size of the choke for a given operating microwave frequency of the oven. Changes during production in the electrical characteristics of the choke structure due, for example, to changes in production tolerances by die wear or changes in material may be compensated for by changing the size of a notch 68 in the end of the dielectric block adjacent the open end of the choke structure which, being the high impedance region of the choke structure, changes its resonant frequency most readily by changing the dielectric constant from that of member 66 to that of air in notch 68.

Figure 6:
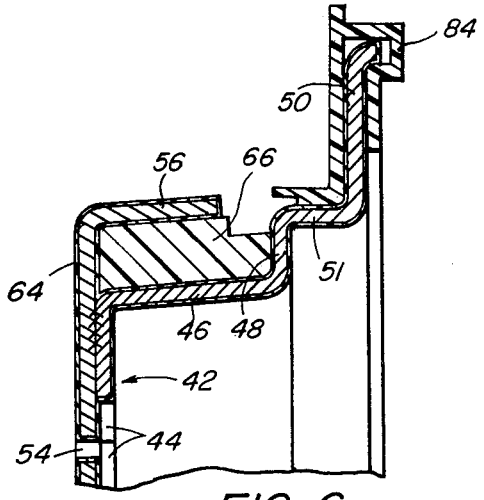

In FIG. 6 there is shown the assembly with the dielectric block 66 locked in place by bending the portions 56 down so that they are substantially perpendicular to the plane of portion 52 and are parallel with the portion 46 to form the choke structure.

Figure 7:
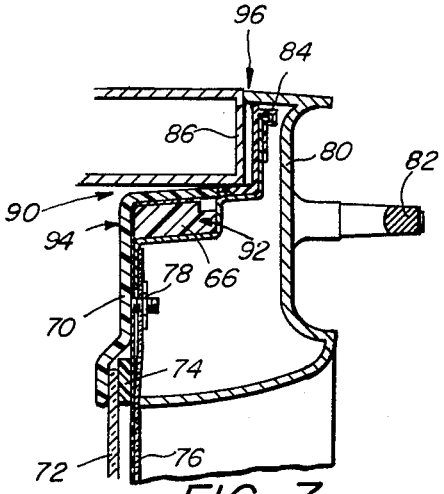
FIG. 7 is a sectional view of the completed unit taken along line 7—7 of FIG. 1.
Figure 8:
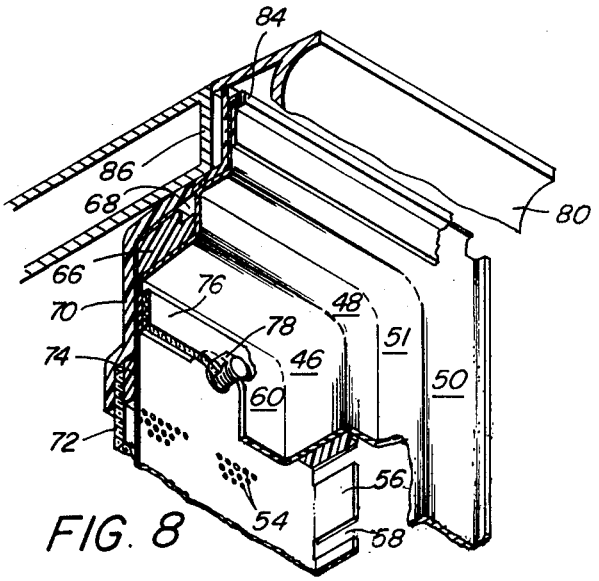
FIG. 8 is a partially broken away perspective view of the detail of the oven illustrated in FIG. 7.

The remaining portions of the door are then put on, as shown in FIGS. 7 and 8, consisting of a dielectric cover 70 on the inside of the door which holds a transparent glass member 72 pressed against resilient sealing ring 74 surrounding the aperture 44 and a protected transparent member 76 on the outside of the door, all held in place, for example, by bolt and nut arrangements 78 attached to the member 70 and extending through holes in the portions 52 and 26. An outer door bezel 80 having a handle 82 is attached by bolts (not shown).

FIG. 8 illustrates a perspective view of a corner structure of the door showing a rounded shape of the door corner formed between the portions 46 and 60 of the first steel member which assists in reducing microwave radiation at the corners.

A lossy gasket ring 84 covers the portion 50 of the first steel member and absorbs any radiation beyond the choke member and forms with the end 86 of the oven wall an output waveguide section indicated generally at 88.

The result is a microwave oven with a door seal structure comprising an input transmission line section 90 whose length is effectively an electrical quarter wavelength from the interior of the oven to the point of coupling to a choke section 92 coupled to the input transmission line in which the distance from said point of coupling to the back wall 94 of the choke is effectively an electrical quarter wavelength at the operating frequency of the oven. An output transmission line section 96 contains lossy gasket 84 which is approximately an electrical quarter wavelength long at said frequency from said point of coupling to the outside of the oven. The slotted wall formed by portions 56 is thus common to the input section 90 and the choke section 92.

The width of members 56 and slots 58 is chosen to avoid transmission of microwave energy along the input and choke structures around the periphery of the door in accordance with the teaching of U.S. Pat. No. 3,767,884 issued Oct. 23, 1973 to Osepchuk et al. By making the choke section of steel, additional loss in the choke has been introduced which reduces the possibility of corona discharge or microwave energy leakage in the regions of the door corners where distortion of the field patterns in the seal may occur due possibly to corner impedance reflections along the seal without said loss being large enough to produce reduction in average sealing around the rest of the door.

This completes the description of the preferred embodiment of the invention disclosed herein. However, many modifications thereof will be apparent to persons skilled in the art without departing from the spirit and scope of this invention. For example, other coatings could be used for the coating 64, and surface treatments of the steel, for example by sand blasting or plating, could be used. In addition, the lossy gasket could be eliminated from the output section or could be other than that shown. Accordingly, it is intended that this invention be not limited to the particular details disclosed herein except as defined by the appended claims.

What is claimed is:

1. The method comprising:

forming wall portions of a microwave energy choke by bending said portions in an annular region of a first conductive member;

forming a second conductive member with portions overhanging said wall portions by bending said wall portions of said second member;

welding said second member to said first member; and coating said wall portions of said first member and said overhanging portions of said second member with a protective nonconductive coating after said second member is welded to said first member.

2. The method in accordance with claim 1 wherein: said first conductive member comprises carbon steel.

3. The method in accordance with claim 1 wherein: said first member has a central aperture larger than a free space wavelength which is closed by said second member.

4. The method in accordance with claim 1 wherein: at least the portions of said first and second members being conductive and forming conductive walls of said choke structure which are coated with low-loss dielectric coating to form said protective coating.

5. The method in accordance with claim 1 and assembling the portions of said first and second coated members forming said choke into a door of a microwave oven with said choke extending around the peripheral region of said door.

6. The method of forming an annular microwave seal comprising:

forming a first portion of an annular microwave choke of said seal by bending peripheral portions of a first sheet of carbon steel;

forming a second portion of said annular microwave choke of said seal from a second sheet of carbon steel by bending peripheral portions of said second member to partially deform wall portions of said choke structure;

welding said partially deformed second member to said deformed first member;

coating the surfaces of said first and second portions of said annular microwave choke of said seal with a protective coating;

placing solid dielectric members around the major portion of said annular microwave choke structure; and locking said solid dielectric members in place by further bending said portions of said second sheet to complete the formation of said partially formed wall portions after said coating of said surfaces.

7. The method in accordance with claim 6 wherein: said partially formed wall portions comprise a slotted wall member extending from the peripheral edges of said second member, with said slotted wall portions having a length which is a function of a quarter wavelength of the frequency of said microwave seal in the medium in said choke.

8. The method in accordance with claim 7 and attaching a solid dielectric cover member over said slotted wall portions.

9. The method in accordance with claim 6 wherein: said seal has an input section, a choke section, and an output section, with said slotted wall being a common wall between said input section and said choke section.

10. The method in accordance with claim 9 wherein: said oven wall forms one wall of said input section.

* * * * *